US005348504A

United States Patent [19]

Pierce et al.

[11] Patent Number: 5,348,504

[45] Date of Patent: Sep. 20, 1994

[54] INFLATABLE LIFESAVING BELT

[76] Inventors: William D. Pierce, 3217 Parkwood Ter., Falls Church, Va. 22042; Kenney J. Pierce, Jr., 136 Ridgeland Dr., Columbus, Miss. 39701

[21] Appl. No.: 937,697

[22] Filed: Sep. 1, 1992

[51] Int. Cl.[5] ..... B63C 9/08

[52] U.S. Cl. ..... 441/113; 441/108

[58] Field of Search ..... 441/80, 81, 84, 92, 441/93, 94, 95, 96, 97, 98, 99, 100, 101, 102, 106, 108, 113, 111, 88

[56] References Cited

U.S. PATENT DOCUMENTS

| | | | |
|---|---|---|---|
| 564,778 | 7/1896 | Brunswig | 441/81 |
| 1,442,746 | 1/1923 | Timberlake | 441/123 |
| 2,118,165 | 5/1938 | Christopher et al. | 9/19 |
| 2,202,415 | 5/1940 | Christopher et al. | 9/19 |
| 2,451,475 | 10/1948 | Craig et al. | 9/19 |
| 2,615,182 | 10/1952 | Podell | 441/113 |
| 2,716,245 | 8/1955 | Desjarlais et al. | 9/19 |
| 2,970,326 | 2/1961 | Keefe | 9/316 |
| 3,952,355 | 4/1976 | Bardebes | 9/316 |
| 4,360,351 | 11/1982 | Travinski | 441/94 |
| 4,379,705 | 4/1983 | Saotome | 441/94 |
| 4,626,221 | 12/1986 | Rocco | 441/108 |
| 5,037,341 | 8/1991 | Howard | 441/89 |

FOREIGN PATENT DOCUMENTS

| | | | |
|---|---|---|---|
| 106667 | 2/1943 | Sweden . | |
| 97341 | 1/1923 | Switzerland | 441/88 |
| 473001 | of 1969 | Switzerland | B63C 9/18 |

*Primary Examiner*—Michael S. Huppert
*Assistant Examiner*—Thomas J. Braham
*Attorney, Agent, or Firm*—Dowell & Dowell

[57] ABSTRACT

An inflatable lifesaving belt for use in water rescues which includes a central portion and enlarged outer end portions which are joined using opposing fastening elements. One or more handles are provided along the central portion of the belt for engagement by a rescuer and, when inflated, the end portions of the belt create a greater degree of buoyancy than the central portion in order to promote face-up floatation of an individual being assisted.

7 Claims, 2 Drawing Sheets

INFLATABLE LIFESAVING BELT

BACKGROUND OF THE INVENTION

1. Field of the Invention

This invention is generally directed to lifesaving devices and, more particularly, to an inflatable belt which is specifically designed for rescuing persons needing assistance in the water. The belt includes a central portion and enlarged end portions each of which is inflatable automatically upon the activation of a gas cartridge which is carried by the belt. The belt is alignable with an individual's body so as to cause the end portions to be positioned across the chest so that upon inflation, a greater degree of buoyancy is created by the enlarged end portions of the belt thus causing the person to float in a face-up orientation. Handles are provided which extend from the central portion of the belt so as to be engageable by a rescuer in order to facilitate maneuvering of the individual during rescue. In the event of the failure of the gas cartridge to inflate, a valve is provided for manual inflation of the lifesaving belt.

2. History of the Related Art

Self-inflating lifesaving devices, including jackets and belts, which are designed to be worn by an individual and provide floatation in emergency situations are well-known. In the past, a great deal of inventive effort has been directed to providing devices which can be conveniently worn by individuals who are participating in activities within the water or by individuals aboard boats and ships to protect them in the event of an accident.

Early self-inflating life preservers are disclosed in U.S. Pat. Nos. 2,118,165 and 2,202,415 to Christopher et al. Such early devices were bladders having gas cartridges which could be activated to inflate the bladder which was attached either to the individual's clothing or to a belt encircling the waist of the individual. In use, the device was designed to be worn about the waist and, when inflated, would inflate only along the forward torso thereby creating a situation wherein the individual was not provided with sufficient buoyancy along the back, neck and shoulder areas. In addition, such structures were designed to be secured to a person before the person entered the water and were not designed to allow rescue of an individual who was not wearing the device before entering the water.

In U.S. Pat. No. 2,451,475 to Craig et al. another type of life preserver belt is disclosed which was specifically designed to be worn as a belt without being attached to an individual's clothing. The lifesaving device included its own fastening elements and was encircled about the waist of a person prior to entering the water. The lifesaving device included a pair of inflatable sections or tubes which extended along the full length of the belt thereby providing equal buoyancy along the length of the belt thus providing some floatation adjacent the back of the person wearing the belt. However, due to the design of the belt, there is no provision made for creating any offset buoyancy so as to insure that an individual is retained in a face-up floatation position upon the activation of the gas cylinders which inflate the belt.

Similar types of inflatable life preserver belts are disclosed in U.S. Pat. Nos. 4,360,351 to Travinski, 4,626,221 to Rocco and 5,037,341 to Howard. Each of these devices included its own fastening elements and was designed to be worn about the waist or chest of an individual. The patent to Travinski is specifically designed to be worn as an article of clothing as a substitute for a conventional belt so as to pass through the loops of a pair of trousers. The belt was worn in a conventional manner and was only inflated in the event of an emergency. As with the reference to Craig et al., when the belt is inflated, the air chamber extends uniformly around the waist and does not provide for any adjustment in buoyancy of the individual during an emergency.

The patent to Rocco was modified to provide a change in buoyancy upon the inflation of the device and included enlarged bladders located along the chest and back. The bladders would engage under an individual's chin and at the back or nape of the neck when inflated. Such a device could present problems if a swimming rescue were attempted due to the positioning of the enlarged bladder positioned at the front and rear of the individual's head.

In order to overcome the problems associated with improper inflation and to provide safe buoyancy for an individual when in the water, one prior life preserver device has been designed which includes a belt which is designed to provide a greater degree of buoyancy along the chest of an individual and a lesser degree along the back of the individual so that the individual is caused to float in a face-up position when the device is inflated. Such device is disclosed in U.S. Pat. No. 4,379,705 to Saotome. However, as with the other life preservers discussed above, the inflatable belt of Saotome is designed to be worn by an individual before entering the water and is activated only in the event the individual should accidently fall into the water or otherwise enter the water in an emergency. Because of this, the belt is designed to be fitted to the individual and aligned before the individual enters the water and it is not designed for securing to an individual in an emergency situation where the individual is already in the water and may either be thrashing or fighting a rescuer giving assistance.

As previously discussed, most of the prior art devices are designed to be worn by individuals before they enter the water and are not designed for emergency rescue situations where a person is already in the water. In this respect, the belts are not provided with any type of handles for allowing a rescuer to engage the belt to thereby facilitate maneuvering an individual during a rescue.

Additional examples of inflatable safety devices are disclosed in U.S. Pat. Nos. 2,716,245 to Desjarlais et al., 2,970,326 to Keefe, 3,952,355 to Bardebes, Swedish patent 106,667 and Swiss patent 473,001.

SUMMARY OF THE INVENTION

This invention is directed to an inflatable lifesaving belt for use during water rescues and which is designed to be placed around the upper torso and below the arms of an individual needing assistance. The belt includes a central section having alignment indicia thereon for centering the belt along the spine so as to insure proper orientation of the belt relative to the individual. The belt further includes enlarged outer end portions which are initially fastened using hook and loop type fastening elements. The elements are fastened in such a manner as to loosely fit the belt about the individual prior to the belt being inflated. For purposes of inflation, a $CO_2$ or other gas cartridge is mounted so as to pressurize the central and end portions of the belt. The belt is formed of a urethane-backed nylon fabric so as to be impervious to the inflation gas. In this respect, the belt is generally inflatable along its entire length, however, due to the enlarged cross-sectional areas of the end portions of the belt which would be fitted against the chest of the individual, a greater buoyancy is created across the chest thereby causing an individual to float in a face-up position when the belt is inflated.

For emergency backup purposes the belt is also provided with a valve through which air may be introduced manually in order to inflate the device in the event the gas cartridge is not operative. The belt further includes a second strap for securing the belt after it is inflated. The second strap extends from one end portion of the belt around to a fastening device such as a buckle loop extending from the other end portion.

To facilitate maneuvering of an individual after the belt has been secured, the belt includes one or more fabric handles which are secured along the central portion thereof. In this manner, the handles may be engaged by a rescuer so the rescuer can pull the individual by the straps which are oriented outwardly of the individual's back. The rescuer is thus free of the arms of a person being assisted in the event the person were to panic.

An additional feature of the lifesaving belt of the present invention is that provisions are made for retaining additional gas cartridges so that the belt may be refitted for use immediately after it has been inflated and subsequently deflated after a rescue or in the event a leak is detected.

It is the primary object of the present invention to provide a lifesaving belt which is designed to be placed about an individual who is in an emergency situation in the water and thereafter inflated so as to support the person in a face-up orientation and which is then engageable along the back of the person so that the rescuer can maneuver the person from behind.

It is another object of the present invention to provide an inflatable lifesaving belt which is specifically designed to provide buoyancy around the upper torso of an individual to which the belt is placed and yet provide additional buoyancy along the chest of the individual to thereby automatically provide for a face-up floatation of the individual being assisted to thereby reduce panic of the individual and thus facilitate rescue operations.

DESCRIPTION OF THE PREFERRED EMBODIMENT

Figure 2:
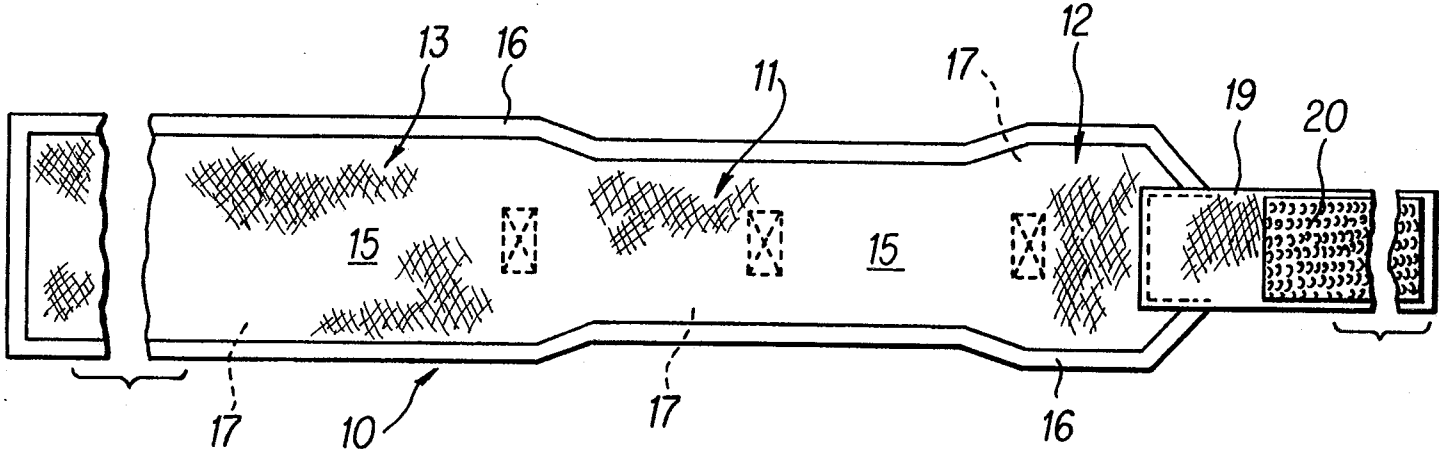
FIG. 2 is a bottom plan view of the lifesaving belt of the present invention having portions broken away.

With continued reference to the drawings, the lifesaving belt 10 of the present invention includes a central portion 11 and enlarged outer portions 12 and 13 which are each defined having an upper or outer nylon layer 14 and an inner nylon layer 15. Each of the upper and lower fabric layers is coated on the inside with a urethane coating to make the fabric impervious to gas. The material layers are heat sealed at 16 around their outer edges so as to define a chamber 17 which is inflatable. In this manner, a continuous inflation chamber is formed from the outer end portion 12 through the reduced central portion 11 and through the outer end portion 13. The continuous inflation chamber is important to insure that the belt provides floatation completely around an individual to which the belt is secured, as will be discussed in greater detail hereinafter.

Figure 5:
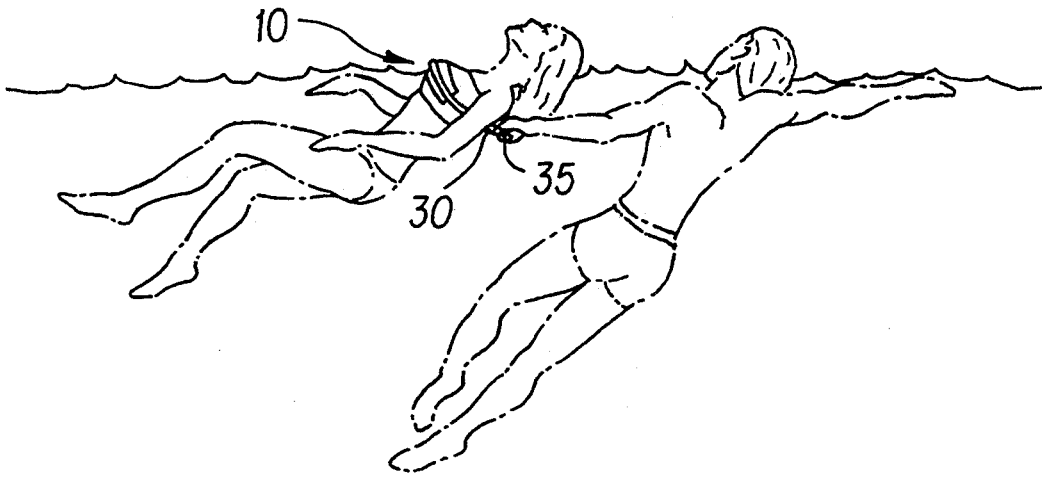
FIG. 5 is an illustrational view showing the lifesaving belt of the present invention in use.
Figure 3:
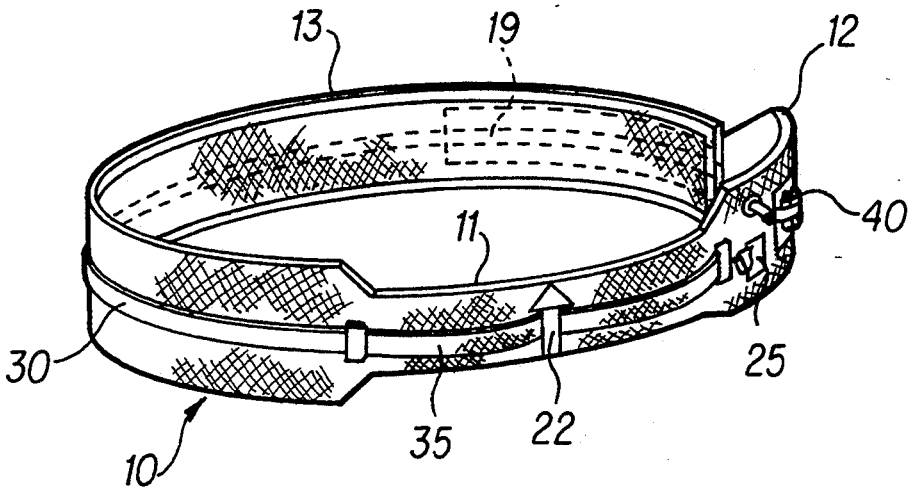
FIG. 3 is a rear perspective view of the lifesaving belt of the present invention showing the end portions fastened together.

To secure the belt about an individual's chests as is shown in FIG. 5, the lifesaving belt includes a loop fabric fastening material 18, which may be "VELCRO", which is secured to the outer layer of the end portion 13. An enlarged strap 19 is secured by appropriate stitching to the opposite end 12 of the belt and extends outwardly therefrom and includes a hook type interengaging fastening material along the inner surface thereof, as is shown at 20. The strap 19 is designed to be positioned over the opposing end portion 13 of the belt and thereafter the loop and hook fabric materials 18 and 20 engaged to secure the belt loosely about an individual being rescued. Due to the length of the strap 19 and the area covered by the fastening loop material 18 provided along the opposite end portion 13, size adjustments may be made to the diameter of the belt.

In use of the first fastening elements of loop and hook fabric materials 18 and 20, it is possible to loosely encircle the belt around an individual needing assistance very quickly and without having to assure exact adjustment of the fastening device for proper fit. However, to assure proper alignment of the belt, an indicia arrow 22 is provided on the outer surface of the belt and along the midpoint of the central portion 11 thereof. The arrow is directed along the spine and towards the head of the individual being rescued. During a rescue, the rescuer merely aligns the arrow generally along the spine of the individual when approaching the individual from the rear and thereafter reaches around with the opposite ends of the belt 12 and 13 and engages them initially utilizing the strap 19 which is secured to outer end portion 13 by the engagement of the loop and hook fabric materials 18 and 20. This placement may be done expeditiously and, by approaching the person from the rear, any unintentional interference by the person being assisted with the rescuer is prevented.

With the belt initially in place, the belt is inflated utilizing a gas cartridge mechanism 24 which may include a $CO_2$ cartridge mounted within a sleeve 25 secured to the outer portion of the belt. A loop 26 extends from the activation pin of the $CO_2$ cartridge and, when pulled, releases the gas from the $CO_2$ cartridge which is then dispensed into the chamber defined between the upper and lower fabric layers of the belt. In the event the $CO_2$ cartridge fails to operate, a manual inflation valve 28 is provided which is secured and sealed through the outer layer 14 of the belt. The manual inflation valve includes a valve stem 29 of the push-pull type which when pulled outwardly allows for inflation of the belt and when pushed inwardly seats the valve to insure that the valve remains closed. Various conventional valves may be utilized in accordance with the teachings of the present invention.

Figure 4:
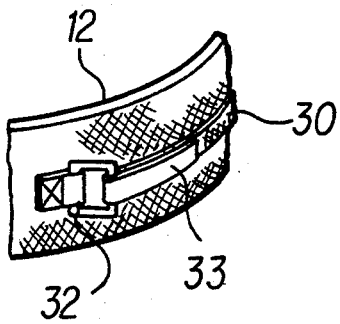
FIG. 4 is a partial perspective view showing the fastening of the outer strap associated with the lifesaving device of the present invention.

Once the belt has been loosely positioned about the individual and inflated, a separate fastening strap is utilized to more securely retain the lifesaving belt to the individual needing assistance. The second fastening elements include an elongated strap 30 which extends along the length of the outer end portion 13 and which is secured at a base portion 31 to the upper fabric layer. The strap is receivable within a belt loop 32 which is secured to the strap 19. In order to provide for a quick fastening of the strap 30 through the buckle loop 32, the outer upper end portion of the strap 30 is provided with a hook type fabric fastening material 33 while the inner portion of the strap is provided with a loop type fabric fastening material 34. As shown in FIG. 4, once the strap has passed through the belt loop and the strap pulled back upon itself, the interengaging fabric hook and loop elements will securely fasten the device to insure a proper fit to the person being assisted.

Figure 1:
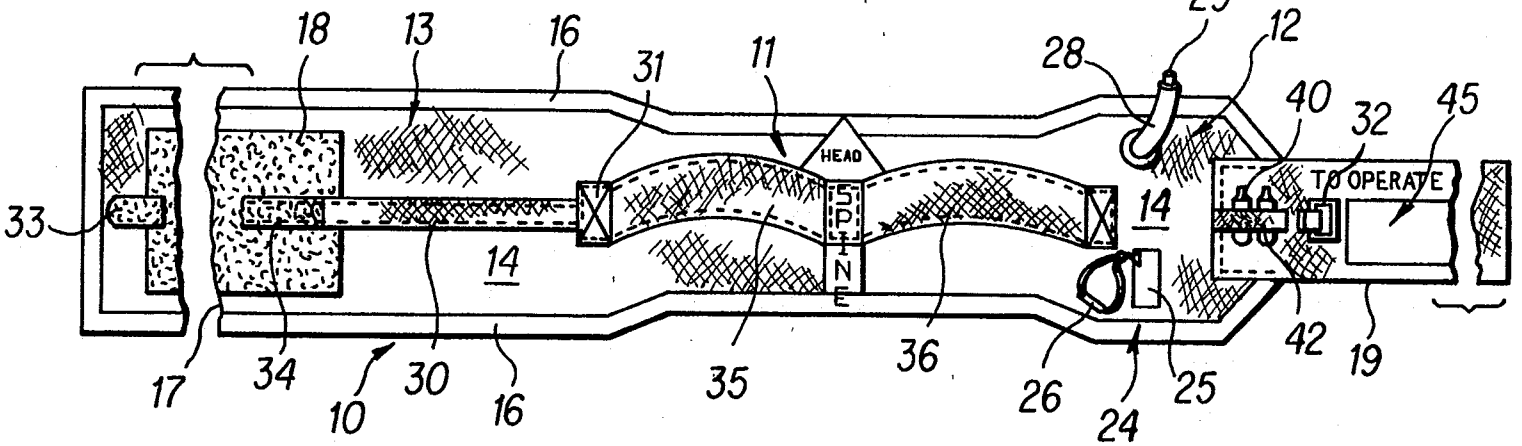
FIG. 1 is a top plan view of the lifesaving belt of the present invention having portions broken away.

In order to allow the rescuer to maneuver an individual to which the belt has been applied, the lifesaving belt of the present invention further includes a pair of nylon fabric handles 35 and 36 which are secured to the upper fabric layer 14 so as to extend from the central portion thereof, as is shown in FIG. 1. The handles are engageable by a rescuer, with the hand of the rescuer thereby being positioned along the back of the person needing assistance. In this manner, the individual being assisted may be pulled through the water utilizing the handles 35 and 36 without the need to position the arm or hand of the rescuer about the individual's upper torso. As is well-known, in many instances, persons become panicked when in the water and can present a potential danger to the rescuer when they loose control and flail their arms; sometimes the rescuers are even attacked. With the lifesaving belt of the present invention the rescuer need only grasp the handles 35 or 36 with one hand thereby allowing the opposite arm to be used to propel both individuals through the water, as is shown in FIG. 5.

In the event that several rescue operations are required within a short time period or a leak develops in the belt, the present invention is designed to provide a spare supply of gas cartridges. In this respect, a pair of cartridges 40 are shown as being mounted to the strap 19 by a secondary retention strap 42 which is secured to the outer surface thereof. Although not shown in the drawing figures, the gas inflation device is designed to retain the gas cartridges in such a position that when the activation device 26 is secured thereto, the cartridges are aligned for proper inflation after being inserted within the pocket 25. In the event someone is not familiar with the use of the lifesaving belt of the present invention, appropriate operating instructions 45 may be provided along the strap 19.

As individual's needing assistance are of different sizes, the lifesaving belt of the present invention is designed to be utilized for both small and large individuals. In this respect, a typical belt may be up to 60" in length. Further, in order to provide adequate buoyancy, the belt may be designed so that the end portions 12 and 13 are 12" from edge-to-edge. This will allow sufficient buoyancy to retain even a heavy adult afloat in the water.

Due to the design of the present invention which incorporates a reduced central inflation chamber area and enlarged outer chamber areas, when the belt is properly aligned, as discussed above, and secured to an individual needing assistance, when the belt is inflated, the amount of buoyancy provided along the chest of the individual is greater than the amount of buoyancy provided along the back of the shoulders. This will cause the individual to float face-up as is shown in FIG. 5 thereby reducing the possibility of panic or accidental water intake in the event the individual is unconscious. The body positioning further facilitates the movement of the individual by pulling on the handles of the device.

We claim:

1. A lifesaving apparatus suitable for being applied about the upper torso and under the arms of an individual in the water comprising an elongated belt having a central inflatable portion and first and second inflatable end portions, an elongated inflatable chamber defined continuously between said first and second end portions and said central portion, said first and second inflatable end portions being of a greater diameter than said central portion to create a relatively greater buoyancy when inflated than said central portion, a first means extending from said first end portion for fastening said first end portion proximate to said second end portion prior to inflation to form a ring in circling engagement about the individual, inflation means for selectively inflating said chamber, an alignment indicia means on said central portion of said belt for selectively aligning said central portion of said belt relative to a specific portion of the backside of the individual so that when said apparatus is applied and said chamber is inflated, said central portion extends substantially along the back portion of the shoulders of the individual and said first and second end portions provide primary buoyancy relative to the frontside of the individual, and handle means mounted along said central portion of said belt and extending outwardly therefrom for being engaged from the backside of the individual when the apparatus is applied.

2. The lifesaving apparatus of claim 1 in which said belt comprises an outer surface and an inner surface, said first fastening means comprises a first element of a hook and loop fabric material secured to the outer surface of said first end portion of said belt, a first strap means extending from said second end portion of said belt, said first strap means having inner and outer surfaces, a second element of a hook and loop fabric material secured to said inner surface of said first strap means, said first and second elements being engageable with one another to secure said belt in circling engagement about the individual.

3. The lifesaving apparatus of claim 2 further comprising a second fastening means having first and second portions, said first portion comprises a second strap means secured to and extending along said second end portion of said belt, and said second portion comprises means for receiving said second strap means therethrough.

4. The lifesaving apparatus of claim 3 in which said second strap means comprises a first hook and loop fabric material along a portion thereof and a second hook and loop fabric material along another portion thereof, said first and second hook and loop fabric materials being engageable with one another when said second strap means is inserted through said means for receiving said second strap means.

5. The lifesaving apparatus of claim 3 in which said inflation means comprises a compressed gas cartridge, and activation means attached to said compressed gas cartridge for allowing gas therefrom to enter into said chamber of said belt.

6. The lifesaving apparatus of claim 5 in which said inflation means further comprises a manual inflation valve secured to said belt and communicating with said chamber.

7. A lifesaving apparatus suitable for being applied about the upper torso and under the arms of an individual in the water comprising an elongated belt having a central inflatable portion and first and second inflatable end portions, an elongated inflatable chamber defined continuously between said first and second end portions and said central portion, said first and second inflatable end portions being of a greater diameter than said central portion to create a relatively greater buoyancy when inflated than said central portion, a first means extending from said first end portion for fastening said first end portion in proximate relationship with respect to said second end portion prior to inflation to form a ring in circling engagement about the individual, inflation means for selectively inflating said elongated chamber within said belt so that when said apparatus is applied and said chamber is inflated, said central portion extends substantially along the back portion of the shoulders of the individual and said first and second end portions provide primary buoyancy relative to the frontside of the individual, and handle means mounted along said central portion of said belt and extending outwardly therefrom for allowing said handle means to be engaged from the backside of the individual when the apparatus is applied.

* * * * *